US007784190B2

(12) United States Patent
So

(10) Patent No.: US 7,784,190 B2
(45) Date of Patent: Aug. 31, 2010

(54) CAN OPENER

(75) Inventor: Shun So, Hong Kong (CN)

(73) Assignee: Union Lucky Industrial Limited, Hong Kong (HK)

( * ) Notice: Subject to any disclaimer, the term of this patent is extended or adjusted under 35 U.S.C. 154(b) by 375 days.

(21) Appl. No.: 11/751,719

(22) Filed: May 22, 2007

(65) Prior Publication Data

US 2008/0289197 A1 Nov. 27, 2008

(51) Int. Cl.
*B67B 7/70* (2006.01)

(52) U.S. Cl. ..... 30/416; 30/418; 30/422; 30/424; 30/425; 30/426; 30/427

(58) Field of Classification Search ..... 30/416–418, 30/422, 424–427; D8/39–41
See application file for complete search history.

(56) References Cited

U.S. PATENT DOCUMENTS

| | | | | | |
|---|---|---|---|---|---|
| 1,556,385 | A | | 10/1925 | Waller | |
| 1,783,534 | A | * | 12/1930 | Darque | 30/422 |
| 2,462,416 | A | * | 2/1949 | Nelson | 30/427 |
| 2,466,117 | A | * | 4/1949 | McLean | 30/426 |
| 2,592,934 | A | * | 4/1952 | McLean | 30/426 |
| 2,617,184 | A | | 11/1952 | Farandatos | |
| 2,694,855 | A | * | 11/1954 | Talge et al. | 30/426 |
| 2,984,904 | A | * | 5/1961 | McLean | 30/426 |
| 3,018,548 | A | * | 1/1962 | Rogers et al. | 30/424 |
| 3,129,509 | A | * | 4/1964 | McLean | 30/426 |
| 3,321,830 | A | * | 5/1967 | McLean | 30/422 |
| 4,028,807 | A | | 6/1977 | DeSisto et al. | |
| 4,520,567 | A | | 6/1985 | Crawford | |
| 4,733,472 | A | * | 3/1988 | Belcourt | 30/422 |
| 5,181,322 | A | * | 1/1993 | Koo | 30/416 |
| 5,197,197 | A | * | 3/1993 | Himmighofen et al. | 30/416 |
| 5,581,897 | A | * | 12/1996 | Liebscher | 30/416 |
| D405,332 | S | * | 2/1999 | So | D8/39 |
| D406,026 | S | * | 2/1999 | So | D8/41 |
| D406,027 | S | * | 2/1999 | So | D8/41 |

(Continued)

FOREIGN PATENT DOCUMENTS

GB 2033869 A * 5/1980

(Continued)

*Primary Examiner*—Jason Daniel Prone
(74) *Attorney, Agent, or Firm*—Leydig, Voit & Mayer, Ltd.

(57) ABSTRACT

A can opener has first and second operating elements pivotal with respect to one another. The first operating element has a rotatable traction wheel and the second operating element has a cutting assembly. The operating elements pivot such that traction wheel and cutter assembly are moveable between an inoperative position and an operative position. In the inoperative position, the traction wheel and cutter assembly are spaced from one another so that the rim of the can to be opened is locatable between the traction wheel and cutter assembly. In the operative position, the traction wheel and the cutter assembly are in close proximity and engagable with the can to effect opening of the can. The cutter assembly has an axle engaged with the second operating element at a first end and has a thread at a second end. A rotatable circular cutting blade is located on the axle between the first and second ends and is held in place by a nut engaged with the thread. A decorative cover covers the nut.

9 Claims, 5 Drawing Sheets

U.S. PATENT DOCUMENTS

| | | | | | |
|---|---|---|---|---|---|
| D409,888 | S | * | 5/1999 | So | D8/41 |
| 6,058,613 | A | | 5/2000 | So | |
| 6,158,130 | A | | 12/2000 | Chong | |
| 6,182,368 | B1 | * | 2/2001 | So | 30/418 |
| 6,647,631 | B2 | * | 11/2003 | So | 30/418 |
| 6,675,487 | B2 | * | 1/2004 | So | 30/418 |
| 6,829,832 | B2 | * | 12/2004 | Chang | 30/418 |
| 6,851,195 | B2 | * | 2/2005 | So | 30/418 |
| D513,950 | S | * | 1/2006 | So | D8/40 |
| D521,827 | S | * | 5/2006 | So | D8/41 |
| 7,168,170 | B1 | * | 1/2007 | So et al. | 30/416 |
| D562,658 | S | * | 2/2008 | So | D8/41 |
| 7,353,607 | B2 | * | 4/2008 | So | 30/416 |
| 7,587,831 | B2 | * | 9/2009 | So | 30/416 |
| 2001/0042312 | A1 | * | 11/2001 | So | 30/426 |
| 2003/0121162 | A1 | * | 7/2003 | So | 30/417 |
| 2004/0064957 | A1 | * | 4/2004 | So | 30/418 |
| 2005/0235501 | A1 | * | 10/2005 | So | 30/425 |
| 2006/0064883 | A1 | * | 3/2006 | So | 30/416 |
| 2006/0101652 | A1 | | 5/2006 | So | |
| 2008/0282558 | A1 | * | 11/2008 | So | 30/427 |

FOREIGN PATENT DOCUMENTS

| | | | | |
|---|---|---|---|---|
| GB | 2220244 | A | * | 1/1990 |
| GB | 2 334 939 | | | 8/1999 |
| GB | 2 341 378 | | | 3/2000 |
| GB | 2 420 108 | | | 5/2006 |
| JP | 11263395 | A | * | 9/1999 |

* cited by examiner

CAN OPENER

BACKGROUND TO THE INVENTION

1. Field of the Invention

This invention relates to a can opener, which may be of a manually operable type, having a rotatable circular traction wheel and a rotatable circular cutter blade for engagement with a metal can for removing an end there from.

2. Background Information

Manually operable can openers have been known for many years and may be broadly categorised into three types: a first type having a cutter blade which cuts directly into an end of the can, a second type having a cutter blade which cuts into the side wall of the can below the rim, and a third type having a cutter blade which cuts into the rim of the can.

The second and third types can be collectively referred to as laterally-cutting types, which are used to remove the end of a can at or below the can rim. A typical laterally-cutting type can opener comprises first and second elongate operating elements pivotally connected to each other. Each operating element has a handle portion. One operating element has a rotatable traction wheel pivotally opposite its handle, and the other operating element has a cutter blade pivotally opposite its handle. Movement of the handles relative to each other moves the traction wheel and cutter blade between an inoperative position to receive a rim of a can there between and an operative position in which the traction wheel and cutter blade engage the rim of the can. During operation of the can opener the two handles must be firmly held together in one hand while an operating handle is turned (to move the can rim between the cutter and traction wheel) with the other hand.

There exists a general need with such can openers to improve the ease of cleaning, to improve aesthetic appearance and to facilitate sharpening or easy replacement operative components. Accordingly, it is an object of the present invention to provide a new and improved can opener of the type having a cutter blade engageable with the rim of a can.

SUMMARY OF THE INVENTION

In accordance with the invention there is provided a can opener comprising a pair of operating elements pivotal with respect to one another, one of the operating elements mounting a rotatable traction wheel and the other one of the operating elements mounting a cutting assembly such that traction wheel and cutter assembly are moveable between an inoperative position in which the traction wheel and cutter assembly are spaced from one another to an extent that the rim of the can to be opened is locatable between the traction wheel and cutter assembly and an operative position in which the traction wheel and the cutter assembly are in close proximity and engagable with the can to effect opening thereof, wherein the cutter assembly comprises an axle engaged with the other one of the operating elements at a first end and having a thread at a second end, and a rotatable circular cutting blade located on the axle between the first and second ends and held in place by a nut engaged with the thread.

Preferably, the axle is fixed to the other one of the operating elements and the circular cutting blade is freely rotatable relative to said operating element.

Preferably, the cutter assembly further includes a friction cover for covering the nut engaged with the thread.

Preferably, the cutter assembly further includes a friction wheel mounting the cutter blade and freely rotatable relative to the axle.

Preferably, the cutter assembly further includes a friction cover that engages with the friction wheel and thereby covers the nut engaged with the thread.

Further aspects of the invention will become apparent from the following description, which is given by way of example only.

BRIEF DESCRIPTION OF THE DRAWINGS

Embodiments of the invention will now be more particularly described, by way of example only, with reference to the accompanying drawings, in which.

DETAILED DESCRIPTION OF THE PREFERRED EMBODIMENT

Figure 1:
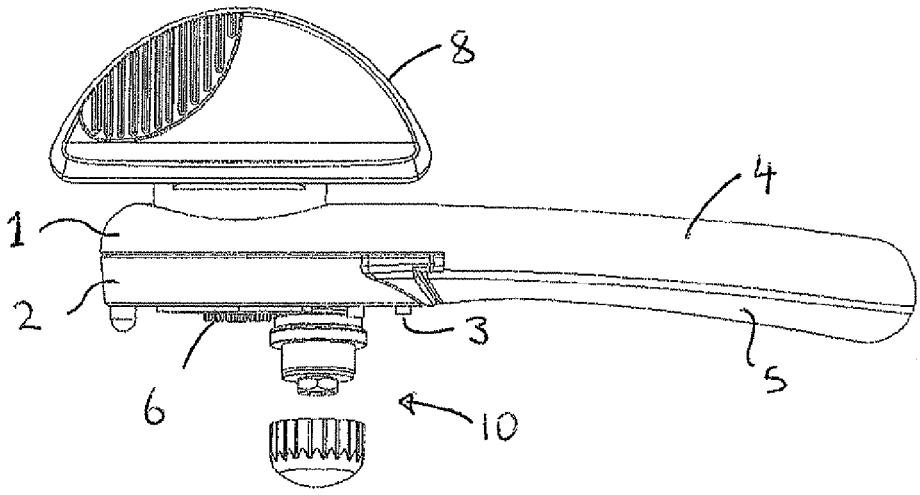
FIG. 1 is a first illustrative view of a can opener according to invention.
Figure 2:
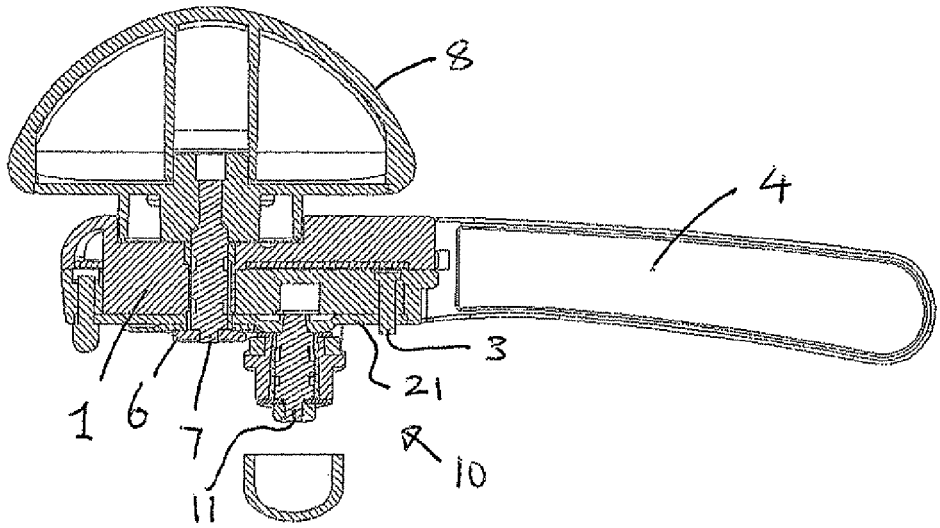
FIG. 2 is a sectional illustrative view of the can opener of FIG. 1.
Figure 3:
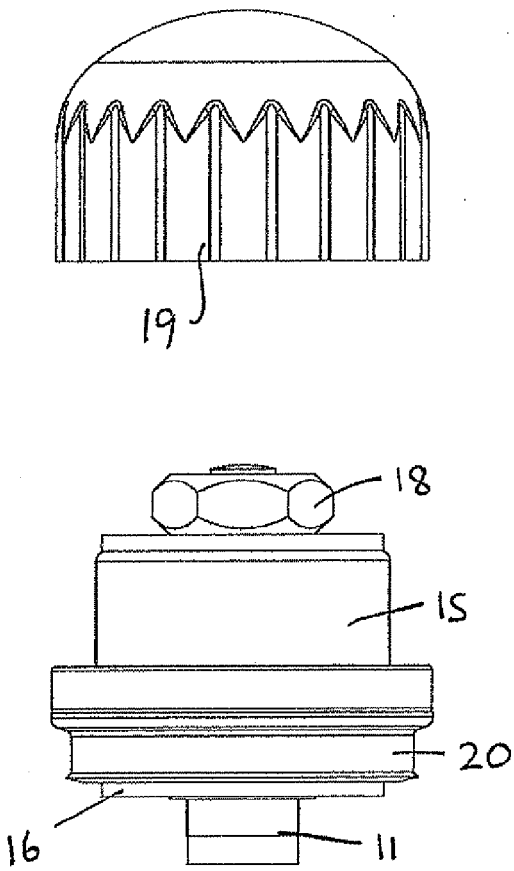
FIG. 3 is an illustrative view of cutter assembly of the can opener.
Figure 4:
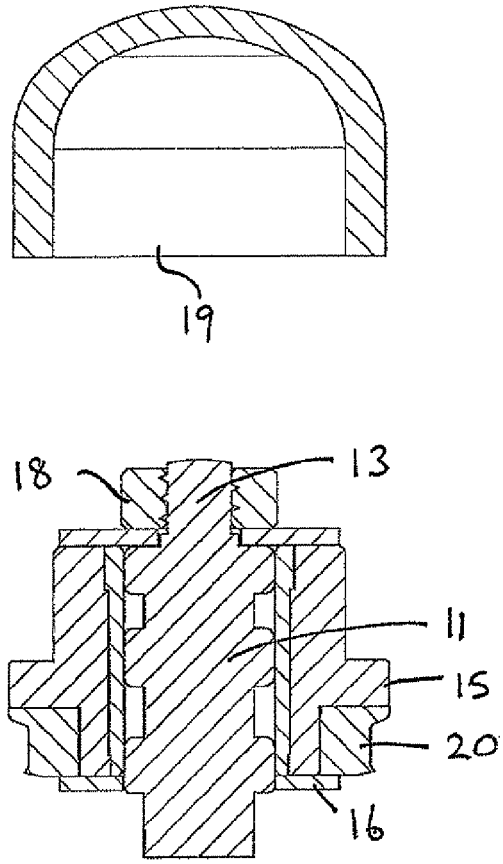
FIG. 4 is a sectional illustrative view through the cutter assembly of FIG. 3.

Applicant's earlier patents; GB 2 334 939 dated 9 Feb. 2000, GB 2 341 378 dated 27 Jul. 2000 and U.S. Pat. No. 6,058,613 dated 9 May 2000; the contents of which are incorporated herein by reference, describe a rim-cutting type can opener. These patents disclose a manually operable can opener of the rim-cutting type that has a pair of operating elements pivotal with respect to one another. A rotatable traction wheel of generally cylindrical configuration is mounted on one operating element and a freely rotatable circular cutter blade is mounted on the other operating element such that the wheel and blade are moveable between an inoperative position in which they are spaced from one another to an extent that the rim of the can to be opened can be locatable between them, and an operative position in which they are in close proximity thereby engaging with the can to effect opening thereof. In their operative position, the cutter blade penetrates a radially outer thickness of metal material comprising the can rim but does not cut completely through the rim whereby the can end may be cut away leaving a smooth edge both to the end and the side wall of the opened can. Complete separation of the cut end from the can body is facilitated by gripper jaws movable by the user to grip that part of the rim attached to the can end to hold and detach it from the remainder of the rim attached to the can body.

Referring to drawings, in a preferred embodiment of the current invention a can opener comprises two operating generally elongate elements 1 and 2 pivotally connected together intermediate their ends by a pivot pin 3. The other ends of the operating elements 1 and 2 are shaped to form handle portions 4 and 5 respectively. The element 1 mounts a generally cylindrical toothed or serrated traction wheel 6 by means of an axle 7 extending through an aperture in the element 1. The traction wheel 6 is rotatable by an operating handle 8 keyed to an opposite end of the axle 7. As will be appreciated, manual rotation of the operating handle 8 will cause corresponding rotation of the traction wheel 6. The traction wheel 6 is of generally cylindrical configuration providing an outer face having a plurality of circumferentially-spaced axially-extending teeth or serrations for gripping a rim of the can to be opened. The other operating element 2 mounts a cutter blade assembly 10 on an axle 11 fixed by one end to and extending from the operating element 2.

Figure 5:
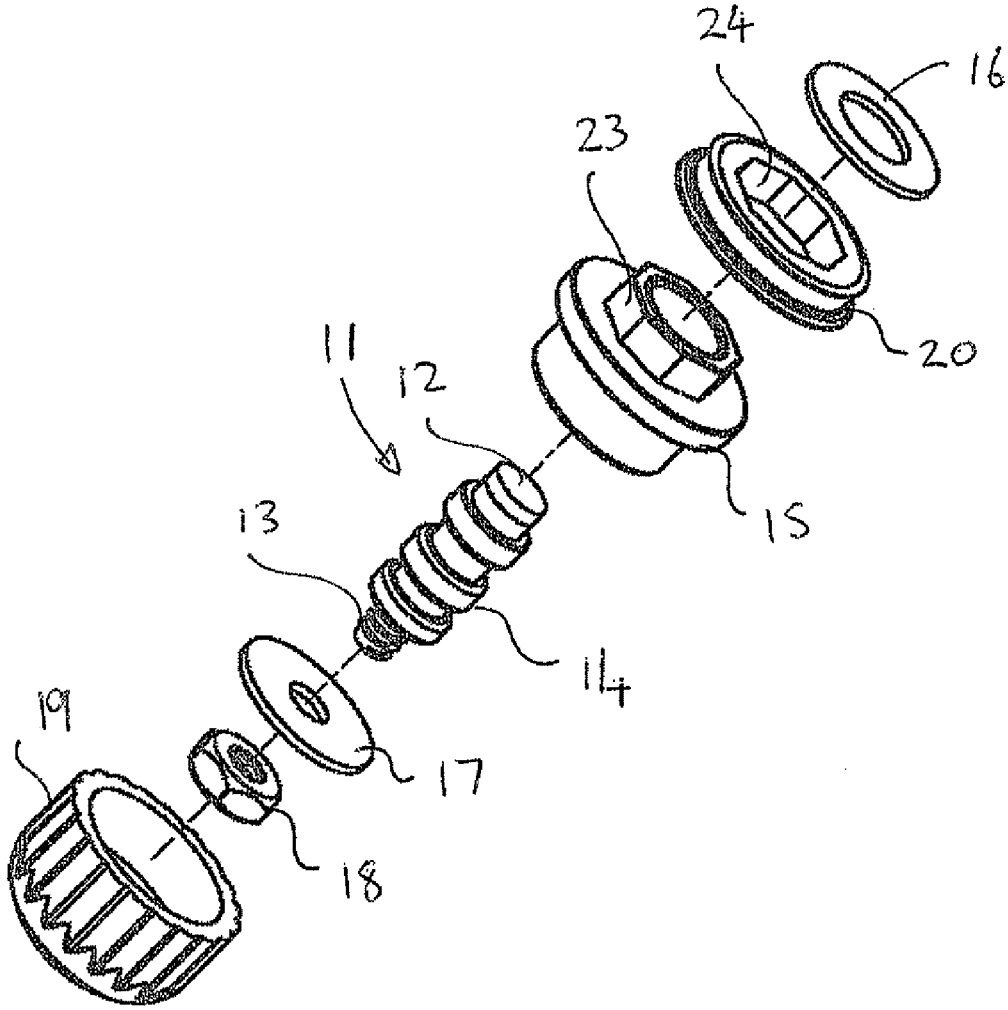
FIG. 5 is an exploded illustrative view of the cutter assembly.

Referring to FIG. 5 specifically, it will be seen that the cutter blade assembly 10 comprises the axle 11, a circular cutter blade 20, a generally cylindrical friction wheel 15 formed of a resilient material, upper and lower washers 16 and 17, a securing nut 18 and a lower cover 19. The friction wheel 15 includes an octagonal boss 23 that locates with an octagonal aperture 24 through the circular cutter blade 20 for mounting the cutter blade 20 to the friction wheel 15.

Figure 6:
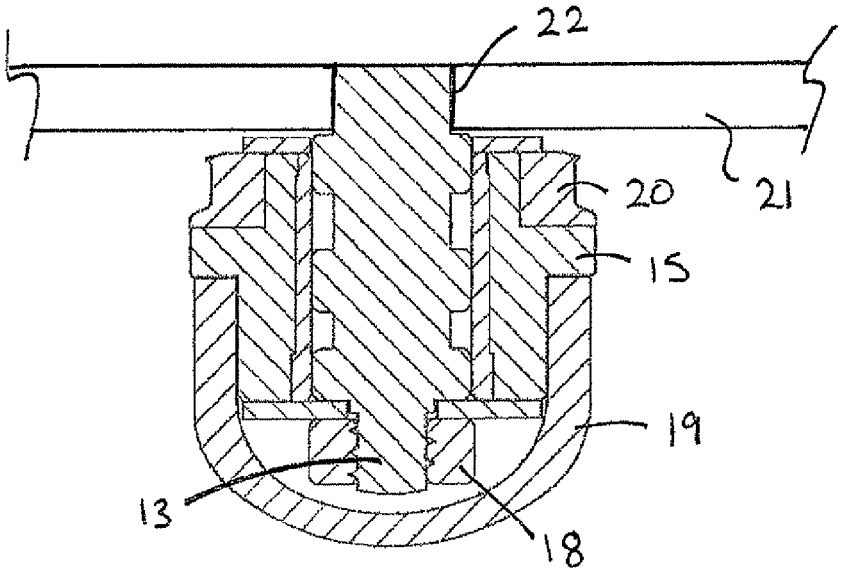
FIG. 6 is a sectional illustrative view through the cutter assembly.

The axle 11 is fixedly assembled with a cover plate 21 (shown in FIGS. 6, 7, and 10) that is fixed to the second operating element 2. A first end 12 of the axle 11 is pressed within an aperture 22 (shown in FIGS. 6, 7, and 10) of the plate 21, creating an interference fit against rotation of the axle 11 relative to the plate 21 and holding the axle 11 securely positioned with respect to the plate 21. The remaining cutter assembly components are located on the axle 11 and held in place by the nut 18 which engages a thread cut at the second end 13 of the axle 11. The friction wheel 15, which holds the cutter blade 20, is freely rotatable about a center portion 14 of the axle 11 so that the cutter blade 20 is freely rotatable relative the second operating element 2.

The cup-shaped cover 19 is a friction fit over the lower portion of the friction wheel 15 covering the lower washer 17 and nut 18 to provide a clean and elegant appearance.

By the above arrangement the cutter blade 20 can be replaced by a user without specialty tools if the blade becomes worn or blunt or for cleaning purposes. The cover 19 is easily removed by gripping between the fingers and pulling to release it from the friction wheel 15. Thereinafter the nut 18 can be loosened and removed using any of a number of suitable hand tools commonly found within a domestic or home environment. The friction wheel 15 and cutter blade 20 slide off the axle 11 after removal of the nut 18. Replacement of the cutter blade 20 and friction wheel 15 after cleaning or with a replacement part is a reverse procedure of passing the friction wheel 15 bearing cutter blade 20 onto the axle 11 with the upper and lower washes 16, 17 in place and engaging the nut 18 with the threaded end 13 of the axle 11 and finally replacing the cover 19 by pushing it into place with the friction wheel 15.

As is fully described in applicant's earlier patents mentioned above, the cutter assembly may be inclined at an angle to the axis of rotation of the traction wheel 6. In normal use when viewed from above (i.e., looking down on the end of the can that is to be removed using the can opener), the operating handle 8 is turned in a clockwise direction, rotating the traction wheel 6 and can in a corresponding clockwise direction and the cutter blade in an anti-clockwise direction. In order to avoid loosening of the nut 18 during operation of the can opener, the threaded end 13 of axle 11 is cut so that the nut 18 tightens in the anti-clockwise rotational direction of the cutter blade during operation.

Figure 7:
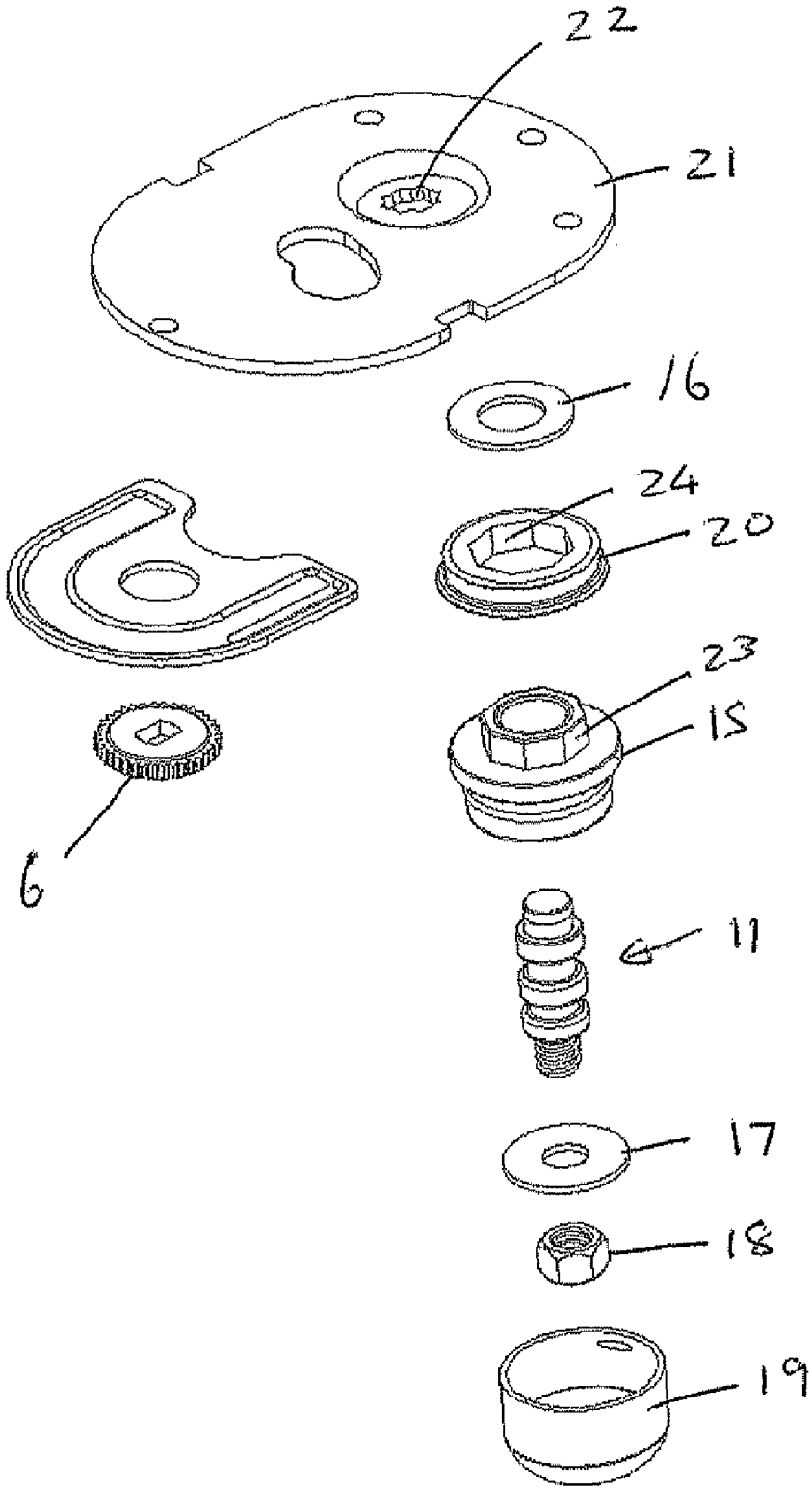
FIG. 7 is a second exploded illustrative view of the cutter assembly with a fixing plate of the can opener.
Figure 10:
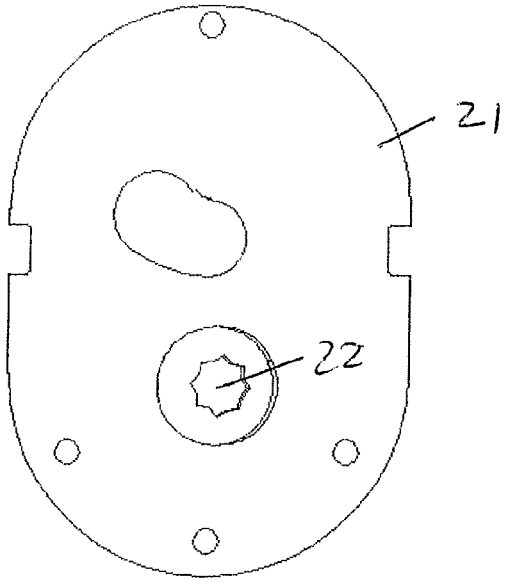
FIG. 10 is an illustrative view of a further alternative embodiment of the fixing plate.
Figure 9:
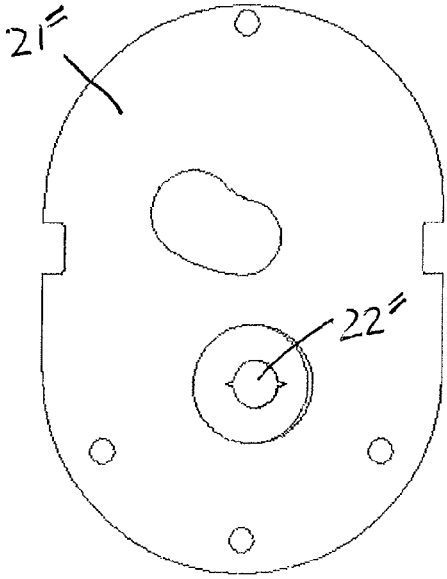
FIG. 9 is an illustrative view of an alternative embodiment of the fixing plate.
Figure 8:
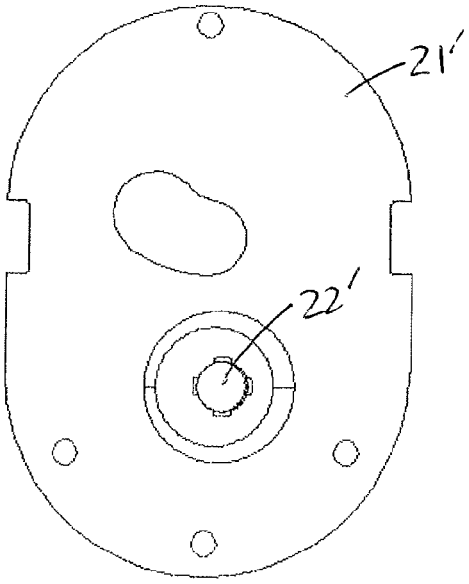
FIG. 8 is an illustrative view of a preferred fixing plate of the can opener.

The end 12 of the axle 11 is an interference fit within the aperture 22 of the plate 21 to prevent rotation of the axle 11 relative to the operating element 2. Various methods of providing such an interference fit are well-known in the art. A first embodiment preferred by the inventor is illustrated in FIG. 8. End 12 of the axle 11 is located within an aperture 22' in a plate 21' and the joint is swaged by deforming the aperture at four points around its periphery. In a second preferred embodiment, the aperture 22" in the plate 21" has two diametrically opposite scores in its periphery to resist rotation of the axle end 12 within the aperture 22" as shown in FIG. 9. In yet another alternative arrangement, the apertures 22 in the plate 21 has a multi-pointed (e.g., star) shaped periphery as shown in FIGS. 7 and 10. The inventor's testing reveals that the embodiment of FIGS. 7 and 10 is the most torque-resistant. In addition, the embodiment of FIG. 8 can be prone to deformation under load which would adversely affect the operative gap between the traction wheel and the cutting wheel.

Embodiments of the invention have been described, however it is understood that variations, improvements or modifications can take place without departure from the spirit of the invention or scope of the appended claims. For example, the described embodiment is a can opener having a pair of operating elements pivotal with respect to one another. However, the skilled addressee will appreciate that the invention can be applied to a single handle, self gripping, can opener such as that described in applicant's/inventor's UK patent application publication 2420108 dated 17 May 2006 and US patent application publication US-2006-0101652-A1 dated 18 May 2006, the entire contents of which are incorporated herein by reference.

What is claimed is:

1. A can opener comprising:

a body;

a rotatable traction wheel and a cutting assembly mounted on the body, wherein the traction wheel and cutter assembly are moveable between an inoperative position, in which the traction wheel and cutter assembly are spaced from one another so that a rim of a can to be opened is locatable between the traction wheel and the cutter assembly, and an operative position, in which the traction wheel and the cutter assembly are in close proximity and engagable with the rim of the can to effect opening of the can, and the cutter assembly comprises an axle having first and second ends, engaged with the body at the first end, and having a thread at the second end, a rotatable circular cutting blade located on the axle between the first and second ends, a nut that is engaged with the thread and that holds the circular cutting blade in place, a friction wheel on which the cutter blade is mounted, the friction wheel being freely rotatable relative to the axle, and a cover that engages and rotates with the friction wheel and that covers and is spaced from the nut that is engaged with the thread.

2. The can opener of claim 1 wherein the axle is fixed to the body and the circular cutting blade is freely rotatable relative to the body.

3. The can opener of claim 1 wherein the body comprises first and second operating elements pivotal with respect to one another, the rotatable traction wheel being mounted on the first operating element and the cutting assembly being mounted on the second operating element.

4. The can opener of claim 1 wherein the body includes an aperture, the axle is engaged within the aperture in the body, and the aperture is swaged to prevent rotation of the axle relative to the body.

5. The can opener of claim 1 wherein the body includes an aperture, the axle is engaged within the aperture in the body, and the aperture has two diametrically opposite scores at the periphery of the aperture to prevent rotation of the axle relative to the body.

6. The can opener of claim 1 wherein the body includes an aperture, the axle is engaged within the aperture in the body, and the aperture has a star-shaped periphery to prevent rotation of the axle relative to the body.

7. A can opener comprising:

first and second operating elements pivotal with respect to one another;

a rotatable traction wheel mounted on the first operating element; and a cutting assembly mounted on the second operating element such that the traction wheel and the cutter assembly are moveable between an inoperative position, in which the traction wheel and the cutter assembly are spaced from one another so that a rim of a can to be opened is locatable between the traction wheel and the cutter assembly, and an operative position, in which the traction wheel and the cutter assembly are in close proximity and engagable with the rim of the can to effect opening of the can, wherein the cutter assembly comprises an axle having first and second ends and engaged with the second operating element at the first end and having a thread at the second end, a rotatable circular cutting blade located on the axle between the first and second ends, a nut that is engaged with the thread and that holds the circular cutting blade in place, a cover covering the nut and spaced from the nut that is engaged with the thread, and a friction wheel on which the cutter blade is mounted, the friction wheel being freely rotatable relative to the axle, the cover engaging and rotating with the friction wheel.

8. The can opener of claim 7 wherein the body includes an aperture, the axle is engaged within the aperture in the body, and the aperture has two diametrically opposite scores at the periphery of the aperture to prevent rotation of the axle relative to the body.

9. The can opener of claim 7 wherein the body includes an aperture, the axle is engaged within the aperture in the body, and the aperture has a star-shaped periphery to prevent rotation of the axle relative to the body.

* * * * *